US010088794B2

(12) United States Patent
Imamura

(10) Patent No.: US 10,088,794 B2
(45) Date of Patent: Oct. 2, 2018

(54) IMAGE FORMING APPARATUS AND PROCESS CARTRIDGE

(71) Applicant: CANON KABUSHIKI KAISHA, Tokyo (JP)

(72) Inventor: Issei Imamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/590,800

(22) Filed: May 9, 2017

(65) Prior Publication Data

US 2017/0329271 A1 Nov. 16, 2017

(30) Foreign Application Priority Data

May 16, 2016 (JP) ..... 2016-097589

(51) Int. Cl.

| | |
|---|---|
| ***G03G 15/00*** | (2006.01) |
| ***G03G 15/04*** | (2006.01) |
| ***G03G 15/05*** | (2006.01) |
| ***G03G 15/20*** | (2006.01) |

(52) U.S. Cl.

CPC ..... *G03G 15/751* (2013.01); *G03G 15/04* (2013.01); *G03G 15/05* (2013.01); *G03G 15/2003* (2013.01)

(58) Field of Classification Search

CPC ..... G03G 21/0064

See application file for complete search history.

(56) References Cited

U.S. PATENT DOCUMENTS 5,412,454 A * 5/1995 Asanae ..... G03G 15/00 361/221

FOREIGN PATENT DOCUMENTS

| | | | |
|---|---|---|---|
| JP | 58-166655 | A | 10/1983 |
| JP | 60-107054 | A | 6/1985 |
| JP | 6-35249 | A | 2/1994 |
| JP | 6-318027 | A | 11/1994 |
| JP | 8-54781 | A | 2/1996 |
| JP | 2003-91181 | A | 3/2003 |

* cited by examiner

*Primary Examiner* — Clayton E Laballe
*Assistant Examiner* — Jas Sanghera
(74) *Attorney, Agent, or Firm* — Canon U.S.A., Inc. IP Division

(57) ABSTRACT

An image forming apparatus includes a rotatably supported photosensitive drum, a charging roller configured to charge the photosensitive drum, a developing sleeve configured to develop an electrostatic latent image formed on a surface of the photosensitive drum and collect toner adhered to the photosensitive drum, an electricity removal sheet disposed on a downstream from the charging roller in a direction of movement on a surface of the photosensitive drum and disposed on an upstream side from the developing sleeve and arranged in contact with the photosensitive drum, and an electricity removal high-voltage power supply configured to apply voltage to the electricity removal sheet. The electricity removal high-voltage power supply an image-forming period applies a DC bias having a polarity identical to a charging polarity of the photosensitive drum and having a lower absolute value than that of the charged potential of the photosensitive drum to electricity removal sheet.

20 Claims, 12 Drawing Sheets

IMAGE FORMING APPARATUS AND PROCESS CARTRIDGE

BACKGROUND OF THE INVENTION

Field of the Invention

The present disclosure relates to an image forming apparatus which forms an image on a sheet by applying electrophotography, such as an electrophotographic copier, an electrophotographic printer (such as a laser beam printer and an LED printer), and a facsimile apparatus. The present disclosure further relates to a process cartridge for use in an image forming apparatus.

Description of the Related Art

An image forming apparatus applying electrophotography forms an electrostatic latent image on a surface of a photosensitive drum functioning as an image bearing member, and causes toner to adhere to the electrostatic latent image through a developing sleeve functioning as developing member for development to form an image. A configuration has been known which uses a cleaning device to remove residual toner on the surface of the photosensitive drum after image forming processing.

In recent years, downsizing and resource saving of image forming apparatuses have been demanded. Accordingly, in order to satisfy such demands, Japanese Patent Laid-Open No. 2003-91181 discloses a configuration which collects toner from a developing sleeve without using a cleaning device.

Generally, a cleanerless system develops an electrostatic latent image and collects toner by using a developing sleeve. In the cleanerless system, toner is collected electrically by the developing sleeve based on a potential difference or an electric field between the surface potential of a charged photosensitive drum and a development bias (development voltage) applied to the developing sleeve. This can realize downsizing of the image forming apparatus, and toner can be reused for effective resource use.

Residual toner on the photosensitive drum surface after image forming may have excessive charges on the toner surface due to a discharge action from a charging member configured to charge the photosensitive drum. In this case, the following problems may possibly occur.

FIG. 11A is a schematic cross-sectional view illustrating a relationship between forces applied to toner adhered to a photosensitive drum surface. As illustrated in FIG. 11A, a toner particle T adhered to the photosensitive drum surface has a force F1 ($kq^2/r^2+R$) acting toward the photosensitive drum (q: charge, E: electric field, k: $1/4\pi\varepsilon$, r: toner particle size) where the force F1 is a sum of an electrostatic force ($kq^2/r^2$) and a non-electrostatic force (R). A force F2 (qE) caused by an electric field with the developing sleeve acts toward the developing sleeve.

If the toner surface has excessive charges due to a discharge action of the charging member and if the forces applied to toner satisfies a relationship of F1>F2, the toner does not move toward the developing sleeve but is absorbed to the photosensitive drum surface. For example, when a state indicated by the horizontal axis q2 as illustrated in FIG. 11B is obtained, toner is held on the photosensitive drum surface.

FIG. 12 is a graph illustrating a result of an experiment comparing a charge amount q[μC]/M[g] per unit weight of toner adhered to a photosensitive drum surface and a collection rate of the toner of a developing unit for finding a relationship therebetween in a cleanerless-system image forming apparatus. As illustrated in FIG. 12, this experiment produces results that toner was substantially completely collected when q/M≤40 and toner was held on the photosensitive drum surface and was not collected when q/M>40.

When the toner adhered to the photosensitive drum surface has excessive amount of charges, as described above, an electrostatically adsorbing force applied to the photosensitive drum surface may sometimes be larger than a force acting on the toner in an electric field generated between the photosensitive drum surface and the developing sleeve in the configuration according to Japanese Patent Laid-Open No. 2003-91181. Thus, the collectability of toner of the developing sleeve may deteriorate, and the residual toner may soil a sheet.

SUMMARY OF THE INVENTION

Accordingly, the present disclosure provides an image forming apparatus which can improve a collectability of toner adhered to an image bearing member by a developing member.

According to an aspect of the present disclosure, an image forming apparatus includes a rotatably supported image bearing member, a charging member configured to charge the image bearing member to make a surface potential thereof to a charged potential, a developing member configured to develop an electrostatic latent image formed on a surface of the image bearing member and collect a developer adhered to the image bearing member, an electricity removal member disposed on a downstream from the charging member and disposed on an upstream side from the developing member in a direction of movement on a surface of the image bearing member and arranged in contact with the image bearing member, and an applying member configured to apply voltage to the electricity removal member. In this case, the applying member applies a direct-current (DC) bias having a polarity identical to a charging polarity of the image bearing member and having a lower absolute value than that of the charged potential of the image bearing member to the electricity removal member in an image-forming period.

Further features of the present disclosure will become apparent from the following description of exemplary embodiments with reference to the attached drawings.

DESCRIPTION OF THE EMBODIMENTS

First Embodiment

Image Forming Apparatus

An entire configuration of an image forming apparatus A according to a first embodiment of the present disclosure and operations in an image-forming period will be described below with reference to drawings. It should be noted that the dimensions, materials, shapes, relative positions and so on of components in embodiments should be changed as required in accordance with the configurations of the apparatuses and conditions under which the present disclosure is applied. Therefore, it is not intended that the scope of the present disclosure is limited thereto only unless otherwise specified.

Figure 1:
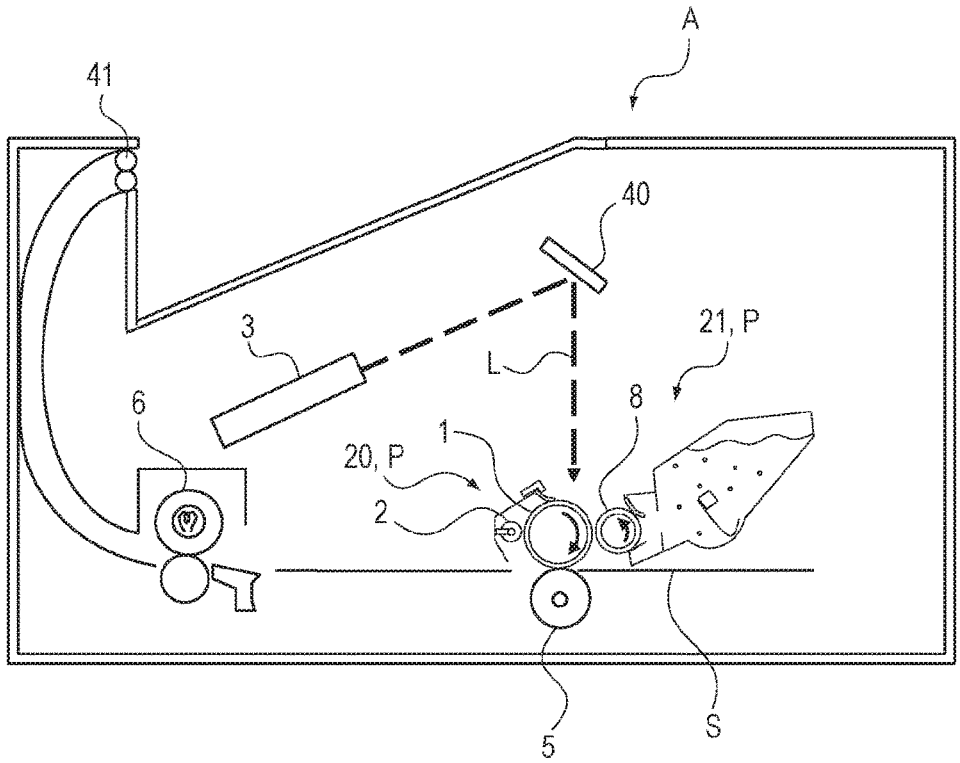
FIG. 1 is a schematic cross-sectional view of an image forming apparatus according to a first embodiment.

As illustrated in FIG. 1, the image forming apparatus A includes an image forming unit configured to transfer a toner image to a sheet, a sheet feed unit configured to supply a sheet to the image forming unit, and a fixing unit configured to fix a toner image to a sheet.

The image forming unit may include a process cartridge P, an optical unit 3 (exposing unit), and a transfer roller 5. The process cartridge P is a cartridge integrally including a photosensitive member unit 20 having a photosensitive drum 1 (image bearing member) and a charging roller 2 (charging member), and a developing unit 21. The process cartridge P is detachably attached to a main body of the image forming apparatus A.

Next, image forming operations will be described. In response to an image forming signal from a control unit (not illustrated) according to an image forming job transmitted by a user, a feeding roller (not illustrated) and a conveyance roller (not illustrated) feed a sheet S stacked and contained in a sheet stacking unit (not illustrated) to the image forming unit.

On the other hand, in the image forming unit, a predetermined direct current (DC) bias is applied to the charging roller 2 so that a surface of the photosensitive drum 1 is charged uniformly to a predetermined polarity and potential.

After that, in response to an image signal, a semiconductor laser, not illustrated, included in the optical unit 3 emits a laser beam L, which is reflected by a mirror 4 to the photosensitive drum 1 for image exposure. Thus, the potential of the photosensitive drum 1 is lowered partially so that an electrostatic latent image based on image information can be formed on the surface of the photosensitive drum 1.

After that, a development bias (development voltage) is applied to a developing sleeve 8 (developing member) included in the developing unit 21 so that the electrostatic latent image formed on the surface of the photosensitive drum 1 can be visualized, and a toner image is formed. The toner image formed on the surface of the photosensitive drum 1 is fed to a transfer nip formed between the photosensitive drum 1 and the transfer roller 5.

When the toner image reaches the transfer nip, a transfer bias (transfer voltage) having a reverse polarity of that of the toner is applied to the transfer roller 5 so that the toner image can be transferred to the sheet.

After that, the sheet having thereon the transferred toner image is fed to the fixing device 6 and is heated and pressurized at a fixing nip formed between a heating unit and a pressurizing unit in the fixing device 6 so that the toner image is fixed to the sheet. After that, the sheet is discharged from the image forming apparatus A through the discharging roller 41.

After the sheet passes through the transfer nip, a development bias is applied to the developing sleeve 8 in the image forming unit. Thus, due to an effect of an electric field formed between the developing sleeve 8 and the photosensitive drum 1, residual toner remaining on the photosensitive drum 1 moves to the developing sleeve 8 to be collected by the developing unit 21.

Process Cartridge

Figure 2:
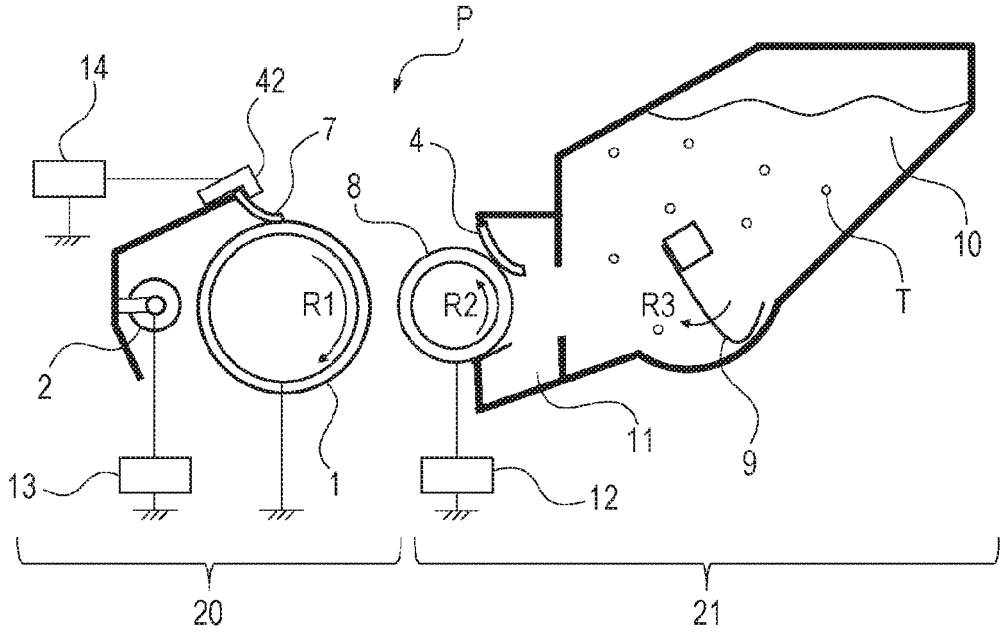
FIG. 2 is a schematic cross-sectional view of a process cartridge according to the first embodiment.

Next, a configuration of the process cartridge P will be described. FIG. 2 is a schematic cross-sectional view of the process cartridge P. The process cartridge P is a cartridge integrally including the photosensitive member unit 20 and the developing unit 21, as described above.

First of all, the photosensitive member unit 20 will be described. Referring to FIG. 2, in the photosensitive member unit 20, the photosensitive drum 1 is rotatably supported, and the charging roller 2 and an electricity removal sheet 7 are placed along a peripheral surface of the photosensitive drum 1.

The photosensitive drum 1 may be formed by coating a photosensitive layer having a film thickness of appropriately 18 μm on an aluminum element tube having a diameter of Φ30 and rotates at 150 mm/sec in a direction indicated by an arrow R1. The process cartridge P is configured such that the aluminum element tube can be grounded when the process cartridge P is attached to the main body of the image forming apparatus A.

The charging roller 2 has a roller diameter of Φ8 and is formed by forming a conductive elastic layer of urethane rubber on a core metal and forming thereon a high resistant layer formed by dispersing carbon black to urethane rubber having a thickness of several μm. Direct current bias (DC bias) is applied from a charging high voltage power supply 13 included in the image forming apparatus A to the core metal for performing charging processing. The high resistant layer of the charging roller 2 may contain an acrylic resin, a nylon resin, or a fluorine resin instead of urethane rubber. A spacing member, not illustrated, is provided on both ends of the core metal of the charging roller 2, and the charging roller 2 is supported in non-contact with the surface of the photosensitive drum 1, specifically with a gap of 100 μm therebetween. This can prevent the charging roller 2 from being soiled with toner, for example. The charging roller 2 and the photosensitive drum 1 are supported such that they are abutted against each other.

The electricity removal sheet 7 may be an SUS sheet being a sheet of stainless steel having a thickness of 50 μm and is fixed to a frame of the photosensitive member unit 20 by a supporting plate 42 of processed stainless steel. The electricity removal sheet 7 is disposed on a downstream side from a charging position facing the charging roller 2 in a rotation direction (moving direction of the surface of the photosensitive drum 1) of the photosensitive drum 1 and disposed on an upstream side from the development position facing the developing sleeve 8 and are arranged in contact with the surface of the photosensitive drum 1. More specifically, the electricity removal sheet 7 is disposed on the upstream side from a region where the optical unit 3 performs exposure processing. The electricity removal high-voltage power supply 14 (applying member) provided in the main body of the image forming apparatus A is configured to apply a bias (voltage) to the electricity removal sheet 7 through the supporting plate 42.

Next, the developing unit 21 will be described. The developing unit 21 includes a toner accommodation unit 10 configured to accommodate toner and a developing part 11 configured to develop. Each of the toner accommodation unit 10 and the developing part 11 has an opening, and they are joined by welding a joint, not illustrated, where the openings are put together.

The toner accommodation unit 10 in an initial state accommodates, as a developer, 200 g of an insulative magnetic single component developer being negative toner having a volume average particle size of approximately 8.0 μm (hereinafter, a toner particle is indicated by T on drawings).

The frame included in the toner accommodation unit 10 is supported such that a mixing/conveying member 9 can rotate. The mixing/conveying member 9 has a sheet of polyethylene terephthalate having a fitting hole fitted to a dowel on an attach axis, and a leading end of the dowel is enlarged by heat welding to fix the sheet to the attach axis. The mixing/conveying member 9 is rotated in a direction indicated by an arrow R3 by a drive unit, not illustrated, to mix toner within the toner accommodation unit 10 and while conveying the toner to the developing part 11 through the openings.

The developing part 11 has an opening in a region facing the photosensitive drum 1, and the developing sleeve 8 functioning as a developer bearing member is provided rotatably where the developing sleeve 8 is partially exposed to the opening. The developing sleeve 8 is a nonmagnetic aluminum sleeve having a surface coated with a resin layer containing conductive particles and has a sleeve diameter of Φ16.0 and a surface roughness of Ra1.0. In image-forming processing, the developing sleeve 8 rotates in a direction indicated by an arrow R2 at 150 mm/sec.

The developing sleeve 8 is electrically connected to the development high-voltage power supply 12 included in the main body of the image forming apparatus A. A development bias (development voltage) is applied to the developing sleeve 8 so that a predetermined electric field is formed between the photosensitive drum 1 and the developing sleeve 8. In a region where the developing sleeve 8 faces the photosensitive drum 1, the electric field moves toner negatively charged to an electrostatic latent image formed on the surface of the photosensitive drum 1, and the toner is electrically absorbed for reversal development.

According to this embodiment, a spacing member, not illustrated, is provided, between the developing sleeve 8 and the photosensitive drum 1 to form a 300-μm gap. In development processing, a bias having alternating-current bias (AC voltage) over a direct-current bias (DC voltage) is applied to the developing sleeve 8. Thus, the developing processing can be performed also in a configuration having such a gap by causing the toner on the developing sleeve 8 to jump to the photosensitive drum 1.

The developing sleeve 8 has a hollow shape and internally contains a magnet roller, not illustrated, in a non-rotary state. The magnet roller has a diameter of Φ14 and has a plurality of magnetic poles of an S1 pole, an N1 pole, an S2 pole, and an N2 pole. With these magnetic poles, toner is supplied to and carried by the developing sleeve 8. According to this embodiment, magnetic forces of the magnetic poles are set as S1 pole: 85 mT, N1 pole: 83 mT, S2 pole: 76 mT, and N2 pole: 77 mT.

A regulating blade 4 hangs above the developing sleeve 8 in a region facing the developing sleeve 8. The regulating blade 4 is elastically abutted with predetermined pressure against the developing sleeve 8 to regulate the amount of toner carried by the developing sleeve 8 to reduce the thickness of the toner, and the toner is negatively charged (pr charged to negative polarity) by triboelectric charging. According to this embodiment, the regulating blade 4 is made of silicone rubber having JISA rubber hardness of 40°, and the contact pressure Pr generated when the regulating blade 4 is abutted against the developing sleeve 8 (or the abutting load per unit length of the developing sleeve in the rotation axial direction) is set to approximately 25 gf/cm.

Electricity Removal Processing

Next, a relationship between a surface potential of the photosensitive drum 1 and a bias (voltage) applied to the members in image-forming processing and an electricity removal step of performing electricity removal on toner having excessive amounts of charges will be described. FIGS. 3A to 3G illustrate a relationship between a surface potential of the photosensitive drum 1 and a bias (voltage) applied to the members in image-forming processing.

Figure 3A:
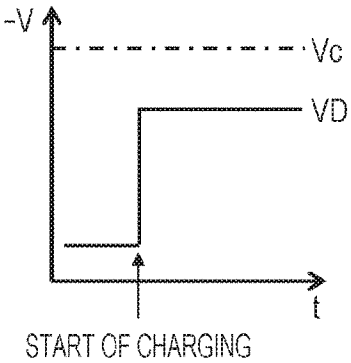
FIGS. 3A to 3G illustrate relationships between surface potentials of a photosensitive drum and biases applied to members.

First of ail, in a charging step, as illustrated in FIG. 3A, a direct current charging bias (charging bias) Vc is applied to the charging roller 2 so that the surface of the photosensitive drum 1 is uniformly charged to a charged potential VD. According to this embodiment, −1800 V direct current bias (DC voltage) is applied as the charging bias Vc so that the charged potential VD of the photosensitive drum 1 can be equal to −700 V.

Figure 3B:
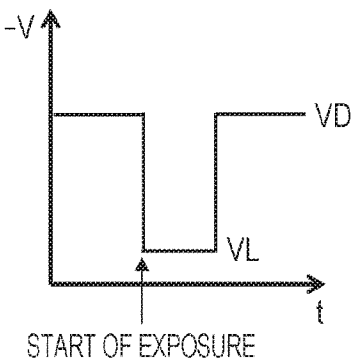

Next, in an exposure step, as illustrated in FIG. 3B, a part, exposed to a laser beam L on the surface of the photosensitive drum 1 is attenuated to a post-exposure potential VL, and an electrostatic latent image generated by a contrast between the charged potential VD and the post-exposure potential VL is formed on the surface of the photosensitive drum 1. According to this embodiment, the post-exposure potential VL is set to be equal to −100 V.

Figure 3C:
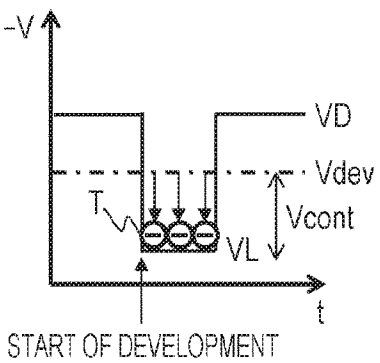

Next, in a development, step, as illustrated in FIG. 3C, a development bias Vdev is applied to the developing sleeve 8 so that the negatively charged toner is supplied to the photosensitive drum 1. Here, a bias is applied such that a relationship of charged potential VD<development bias Vdev<post-exposure potential VL can be satisfied where the positive side is assumed to be larger. Thus, an electric field with a potential difference Vcont between the development bias Vdev and the post-exposure potential VL causes the toner carried by the developing sleeve 8 to be adhered to the electrostatic latent image on the photosensitive drum 1 so that the image can be developed. According to this embodiment, a −350 V direct current bias as a development bias Vdev and an alternating-current bias having 1800 Vpp, a frequency of 1500 Hz and a rectangular waveform are applied so that the potential difference Vcont can be equal to 200 V.

Figure 3D:
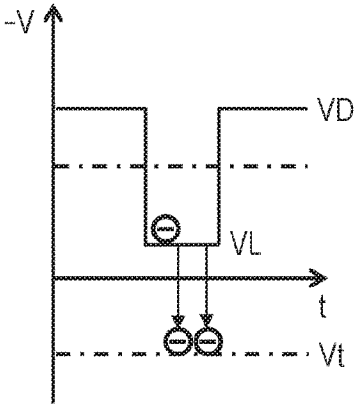

Next, in a transferring step, a transfer bias Vt having a reverse polarity of that of the toner, that is a positive polarity according to this embodiment is applied to the transfer roller 5 as illustrated in FIG. 3D. Thus, the toner image formed on the photosensitive drum 1 is drawn to and is transferred toward the sheet. Here, residual toner which has not been fully transferred remains on the photosensitive drum 1 after the transferring processing.

Figure 3E:
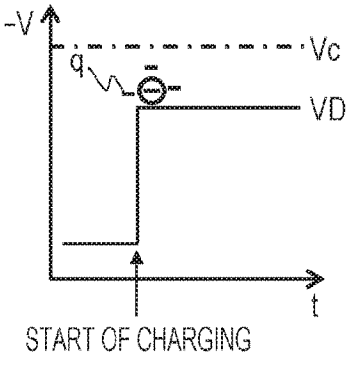

Next, in the second charging step, as illustrated in FIG. 3E, charging processing is performed on the surface of the photosensitive drum 1 with the residual toner remained. Here, the residual toner contains toner having an excessive amount of charges (hereinafter, called a charge-up toner) generated by a discharging effect from the charging roller 2.

In the charge-up toner, as described above, a force applied to the toner electrostatically adsorbed to the surface of the photosensitive drum 1 is larger than a force acting toward the developing sleeve 8 due to an electric field between the photosensitive drum 1 and the developing sleeve 8. In this case, the toner collectability of the developing sleeve 8 deteriorates in development and collection steps, which will be described below.

Figure 3F:
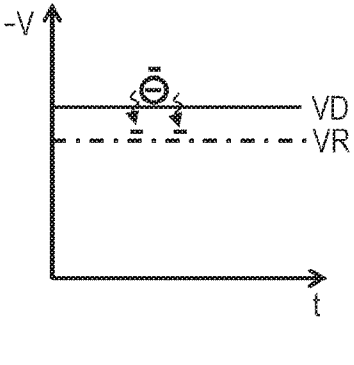

Accordingly, in the next electricity removal step, electricity removal is performed on the charge-up toner. In the electricity removal step, as illustrated in FIG. 3F, a direct-current electricity removal bias VR is applied to the electricity removal sheet 7 where the electricity removal bias VR has the same polarity as the charging polarity of the surface of the photosensitive drum 1 and is smaller in absolute value than the charged potential VD. According to this embodiment, −550 V is set to be applied as an electricity removal bias VR. The rotation of the photosensitive drum 1 brings into contact the electricity removal sheet 7 to which the electricity removal bias VR is applied and the charge-up toner adhered to the surface of the photosensitive drum 1.

At this point in time, a positive electric field is generated from the photosensitive drum 1 charged to the charged potential VD toward the electricity removal sheet 7. The effect of the positive electric field releases the charges on a surface of the charge-up toner to a ground side through the electricity removal sheet 7. Thus, the amount of charges held by the residual toner can be reduced because of electricity removal on the charge-up toner.

When the charge-up toner undergoes the electricity removal, the amount of charges q of the toner decreases. Thus, the force F1 ($kq^2/r^2+R$) acting on the photosensitive drum 1 and the force F2 (qE) acting on the developing sleeve 8 against the toner satisfies a relationship of F1<F2 (where q: amount of charges, E: electric field, k: $\frac{1}{4\pi\varepsilon}$, r: toner particle size). Therefore, in the development and collection steps, which will be described below, the collection rate for collecting residual toner by the developing sleeve 8 can be improved.

Figure 4:
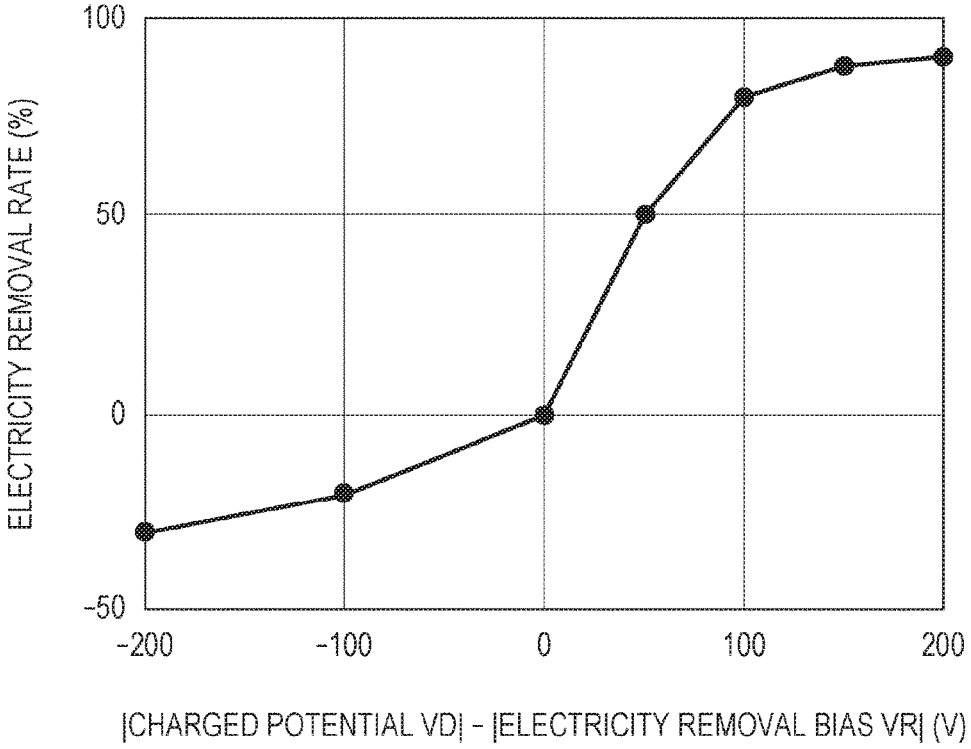
FIG. 4 is a graph illustrating a result of a measurement of an electricity removal rate of toner.

Next, the electricity removal rate for toner by the electricity removal sheet 7 will be described. FIG. 4 is a graph illustrating results of measurement of the electricity removal rate (q/M) for toner, which is calculated by the following Expression (1), against different values of |charged potential VD-electricity removal bias VR|.

$$\text{Electricity removal rate } \% = (100 \times (q/M \text{ after electricity removal step})/(q/M \text{ before electricity removal step})) \quad (1)$$

As illustrated in FIG. 4, with application of a bias having a lower absolute value than the charged potential VD as an electricity removal bias VR, electricity removal for toner can be performed. As the electric field intensity increases in the positive direction, the degree of facilitation of movement of charges of the toner toward the electricity removal sheet 7 can be increased, and the electricity removal rate for the toner can be increased.

Figure 5:
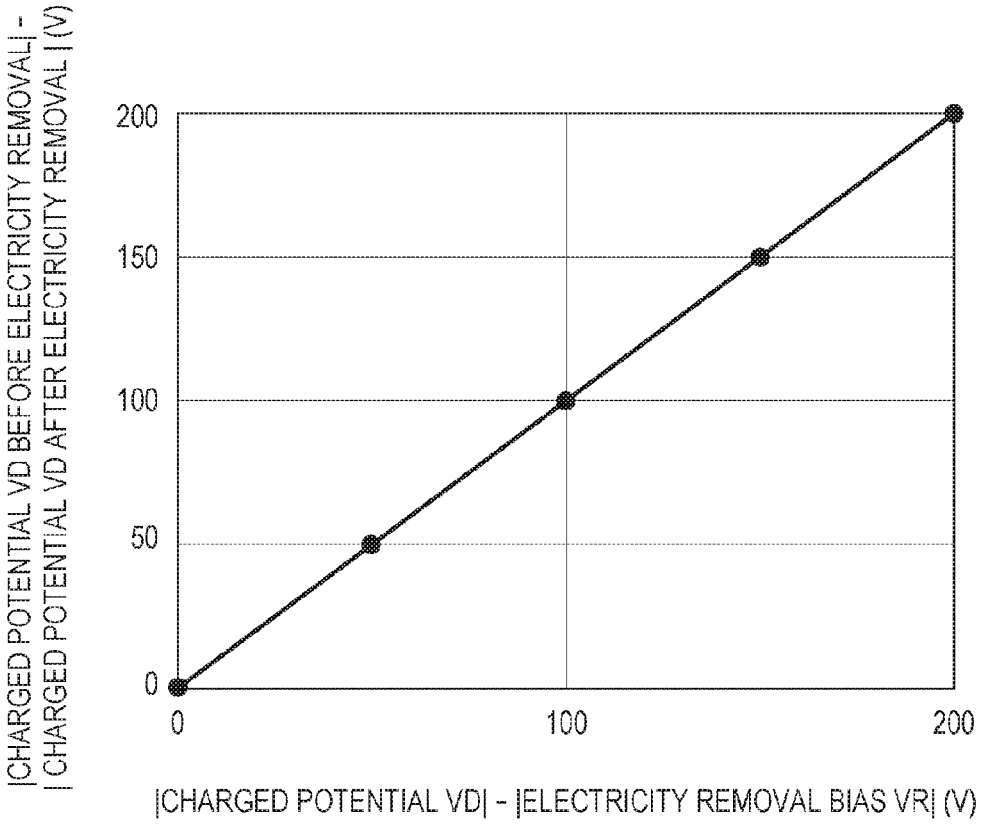
FIG. 5 is a graph illustrating a relationship between an electricity removal bias value and a charged potential of a photosensitive drum surface after electricity removal.

On the other hand, when the electricity removal step performs electricity removal on toner, the surface of the photosensitive drum 1 at the same time may undergo the electricity removal with some magnitude of the electricity removal bias VR. In other words, as illustrated in FIG. 5, as the value of |charged potential VD|−|electricity removal bias VR| increases, the charged potential VD of the surface of the photosensitive drum 1 after the electricity removal step decreases. Because of this, the electricity removal bias VR and the charging bias Vc may be set in consideration of the electricity removal. More specifically, the charging bias Vc and the electricity removal bias VR may be set to have values acquired by adding a charged potential VD (|charged potential VD before electricity removal|−|electricity removal bias VR|) to be removed in the electricity removal step to a target charged potential VD (|VL|+|Vcont|+|Vback|). This can improve the toner collectability and at the same time keep image characteristics.

Figure 3G:
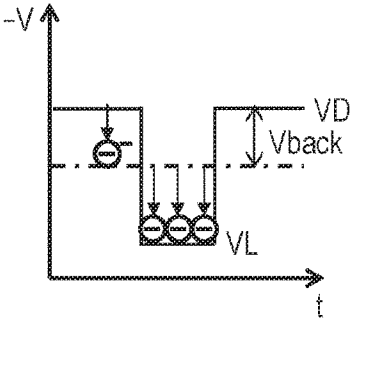

Next, in the collection and development steps, as illustrated in FIG. 3G, negatively charged toner moves toward and is collected by the developing sleeve 8 due to an electric field of a potential difference Vback between the charged potential. VD and the development bias Vdev in a region having the charged potential VD where the surface of the photosensitive drum 1 is not exposed. At the same time, toner carried by the developing sleeve 8 moves toward the photosensitive drum 1 for performing development processing in a region having the post-exposure potential VL where the surface of the photosensitive drum 1 is exposed.

Here, the potential difference Vback between the charged potential VD and the development bias Vdev before an electricity removal step is equal to 350 V. However, because, as described above, the charged potential VD after an electricity removal step decreases, the charged potential VD and the electricity removal bias VR are to be set in consideration of the amount reduced by the electricity removal. According to this embodiment, the Vback value after an electricity removal step is set to be 200 V equal to a potential difference with which the developing sleeve 8 can collect toner. The aforementioned steps are executed to implement the image forming processing.

Results of Examinations of Toner Collectability

Figure 6:
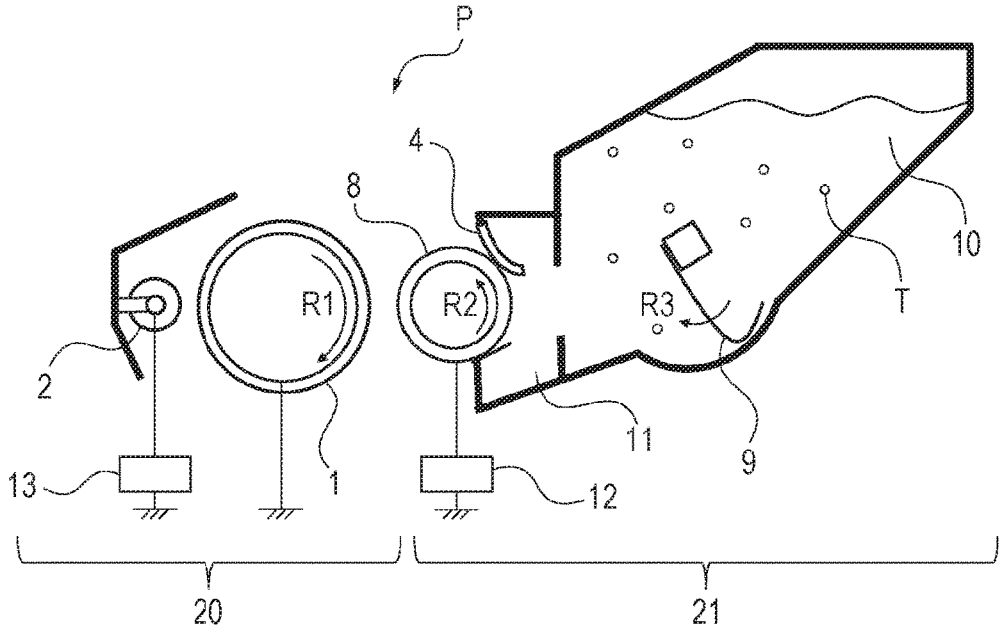
FIG. 6 is a schematic cross-sectional view of a process cartridge according to a comparative example.

Next, results of an experiment examining a toner collectability of the developing unit 21 will be described. In this experiment, toner weights M[g]/S [cm 2] per unit area of the developing sleeve 8 before and after passage of toner on the surface of the photosensitive drum 1 through a development nip are measured, and a collection rate is calculated by the following Expression (2) for examination. As a first comparative example, a collection rate in a configuration. (FIG. 6) without the electricity removal sheet 7 was calculated.

$$\text{Collection rate } \% = 100 \times (M/S \text{ after passage through the development nip})/(M/S \text{ before passage through the development nip}) \quad (2)$$

The examination results in a collection rate of 99% the configuration according to this embodiment having the electricity removal sheet 7. On the other hand, the collection rate is equal to 5% in the configuration of the comparative example without the electricity removal sheet 7. The lower collectability of the configuration of the comparative example is caused by a relationship F1>F2 between the force F1 applied to the residual toner toward the photosensitive drum 1 and the force F2 applied to the toner toward the developing sleeve 8 because the residual toner excessively obtains charges from the discharge from the charging roller 2.

It was found also from this experiment results that the configuration of this embodiment can improve the toner collectability of the developing sleeve 8.

Second Embodiment

Next, a second embodiment of the image forming apparatus A according to the present disclosure will be described with reference to FIG. 7. Like numbers refer to like parts in the first and second embodiments, and any repetitive description will be omitted.

Residual toner after a charging step contains not only charge-up toner but also toner having a lower amount of charges. Because such toner having a lower amount of charges has lower electrostatic adhesion to the photosensitive drum 1, an electric field effect in an electricity removal step removes the charges from the surface of the photosensitive dram 1 and is adhered to the electricity removal sheet 7. Repeating the image forming under this condition, the amount of toner adhered to the electricity removal sheet 7 may gradually increase, and the surface of the electricity removal sheet 7 may possibly be covered with the toner. In this case, because the toner on the photosensitive drum 1 is not brought in contact with the electricity removal sheet 7, the charge-up toner may not undergo electricity removal, which deteriorates the toner collectability of the developing sleeve 8.

According to this embodiment, in a non-image-forming period, a bias having the same polarity as that of the charged potential VD of the photosensitive drum 1 in an image-forming period is applied to the electricity removal sheet 7. This can move the toner adhered to the electricity removal sheet 7 to the photosensitive drum 1 and thus can improve the poor electricity removal due to the toner adhesion in the non-image-forming period.

Figure 7:
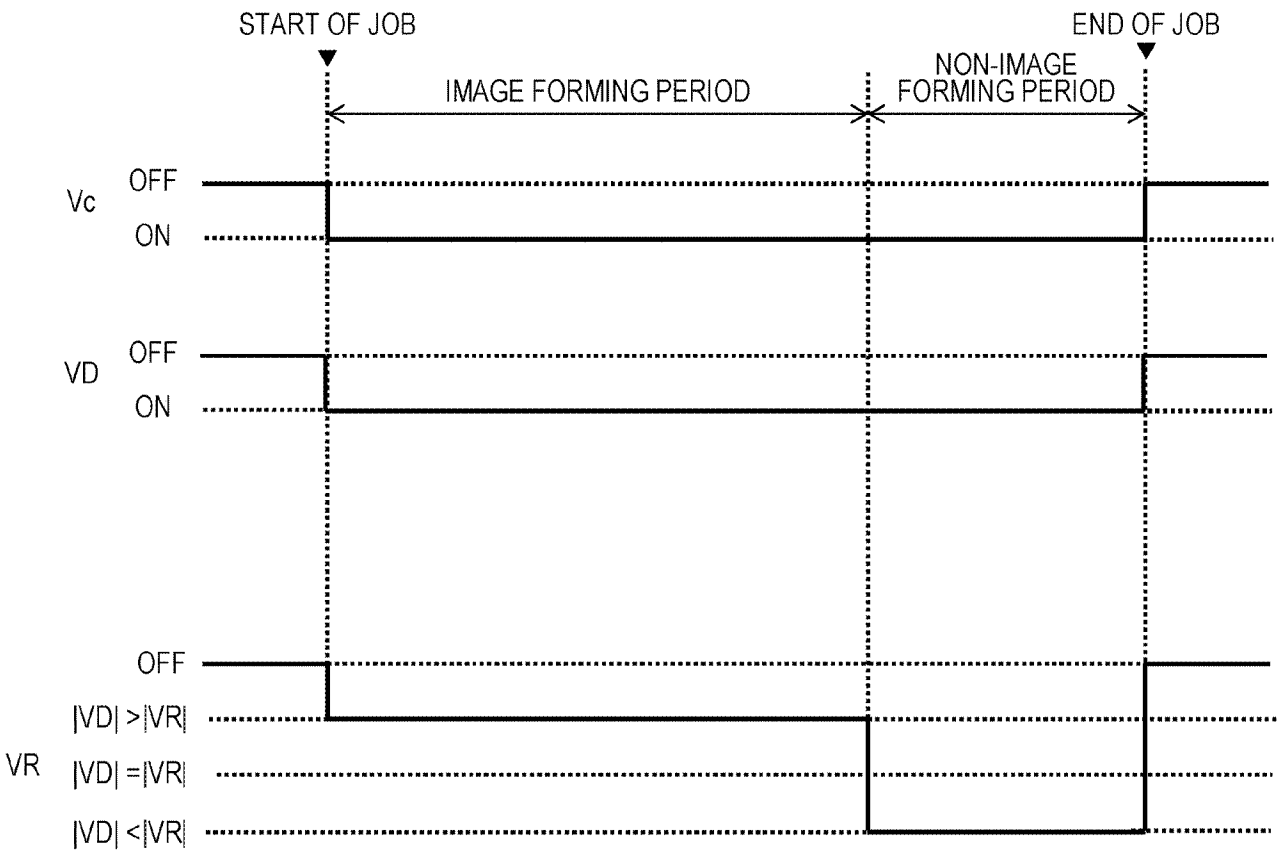
FIG. 7 illustrates timing and magnitudes of biases to be applied to members in an image forming apparatus according to a second embodiment.

FIG. 7 illustrates timing and magnitudes of biases to be applied to members in a period from a time when a job is received to a time when the job ends in the image forming apparatus A according to this embodiment. According to this embodiment, as indicated by solid lines in FIG. 7, an electricity removal bias VR is applied in a non-image-forming period where the bias VR has the same polarity as that of the charged potential VD of the photosensitive drum 1 in an image-forming period and has a higher absolute value than that of the charged potential VD of the photosensitive drum 1 before the electricity removal step is executed. According to this embodiment, the charged potential VD of the photosensitive drum 1 before the electricity removal step is equal to −700 V, and the electricity removal bias VR to be applied to the electricity removal sheet 7 in a non-image-forming period is set to −800 V. FIG. 7 illustrates [VD] before the electricity removal step.

This can generate a positive electric field from the photosensitive drum 1 charged with the charged potential VD toward the electricity removal sheet 7. Thus, because of an effect of the electric field, the negative toner adhered to the electricity removal sheet 7 can be moved toward the photosensitive drum 1. This can prevent the state that the surface of the electricity removal sheet 7 is covered by toner, and electricity removal of charge-up toner and improved toner collection rate can be realized in a stable manner for a long period.

According to this embodiment, the photosensitive drum 1 performs the control under a condition that the photosensitive drum 1 is charged with the charged potential VD. However, embodiments of the present disclosure are not limited thereto. In other words, for example, it may be configured such that a bias (voltage) having the same polarity as that of the charged potential VD of the photosensitive drum 1 in an image-forming period is applied to the electricity removal sheet 7 in a non-image-forming period to form an electric field for moving toner toward the photosensitive drum 1, such as a configuration in which the bias is applied after a job completes. The toner moved toward the photosensitive drum 1 is collected by the developing unit 21.

Third Embodiment

Next, a third embodiment of the image forming apparatus A according to the present disclosure will be described with reference to FIGS. 8A and 8B. Like numbers refer to like parts in descriptions and drawings of the first, second and third embodiments, and any repetitive description will be omitted.

Like the first embodiment, when the electricity removal step is executed, the photosensitive drum 1 undergoes electricity removal simultaneously with the electricity removal of toner, and the charged potential VD decreases. Thus, the charging bias Vc in consideration of the amount of charges to be removed is to be applied. On the other hand, when the charging bias Vc gets excessively higher, there is an increased possibility that the charging bias Vc may leak if the photosensitive layer of the photosensitive drum 1 may be damaged by paper, for example, reducing the dielectric strength.

According to this embodiment, toner is caused to pass through an electricity removal nip formed by the electricity removal sheet 7 and the photosensitive drum 1 at a lower speed than the rotation speed of the photosensitive drum 1. This can improve the efficiency of the toner electricity removal and reduce the risk of the charging bias VC leakage with lowered electricity removal bias VR and a charging bias Vc value set in consideration of the amount of charges to be removed.

Figure 8A:
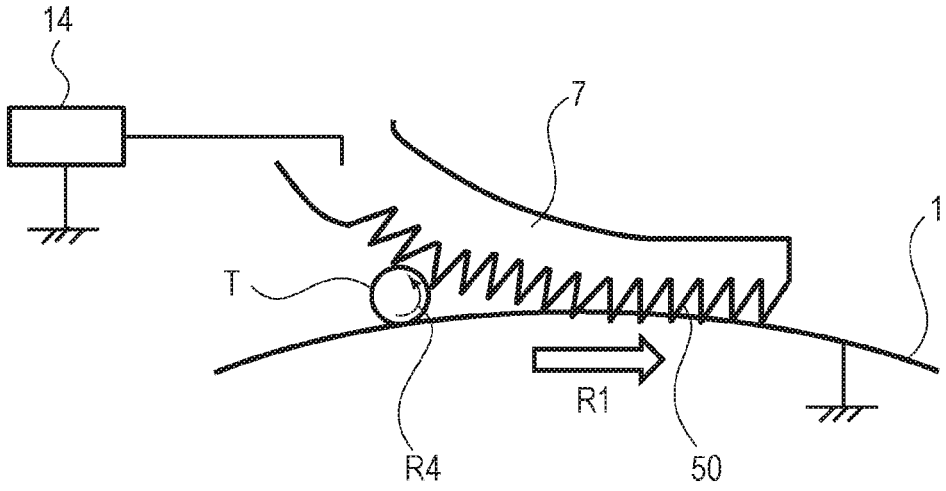
FIG. 8A is a schematic cross-sectional view of a region neighboring to an electricity removal sheet according to a third embodiment.

More specifically, as illustrated in FIG. 8A, an uneven part 50 is provided by performing an unevenness treatment on a surface of the electricity removal sheet 7. Thus, toner particles T are caught by the uneven part 50, rotate in a direction R4 opposite against the rotation direction R1 of the photosensitive drum 1, and pass through an electricity removal nip at a lower speed than the rotation speed of the photosensitive drum 1. The time taken by the toner for passing through the electricity removal nip increases the opportunities that the charges on the surfaces of the toner particles T are brought into contact with the surface of the electricity removal sheet 7, which may improve the electricity removal rate for the toner. Therefore, the charging bias Vc can be set lower, and the risk for leakage of the charging bias Vc can thus be reduced.

Figure 8B:
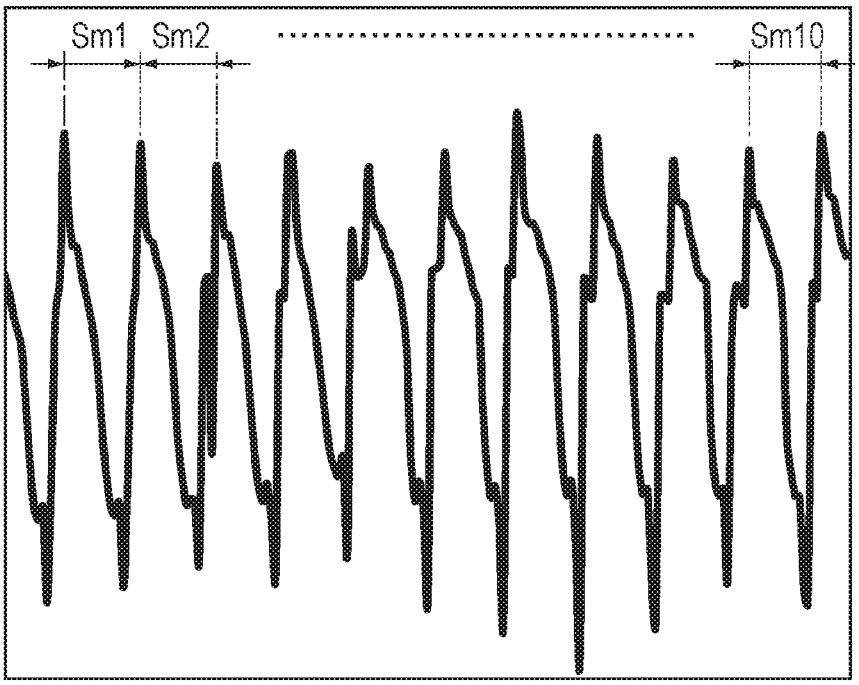
FIG. 8B illustrates measurement results of interval values of concaves and convexes.
Figure 10:
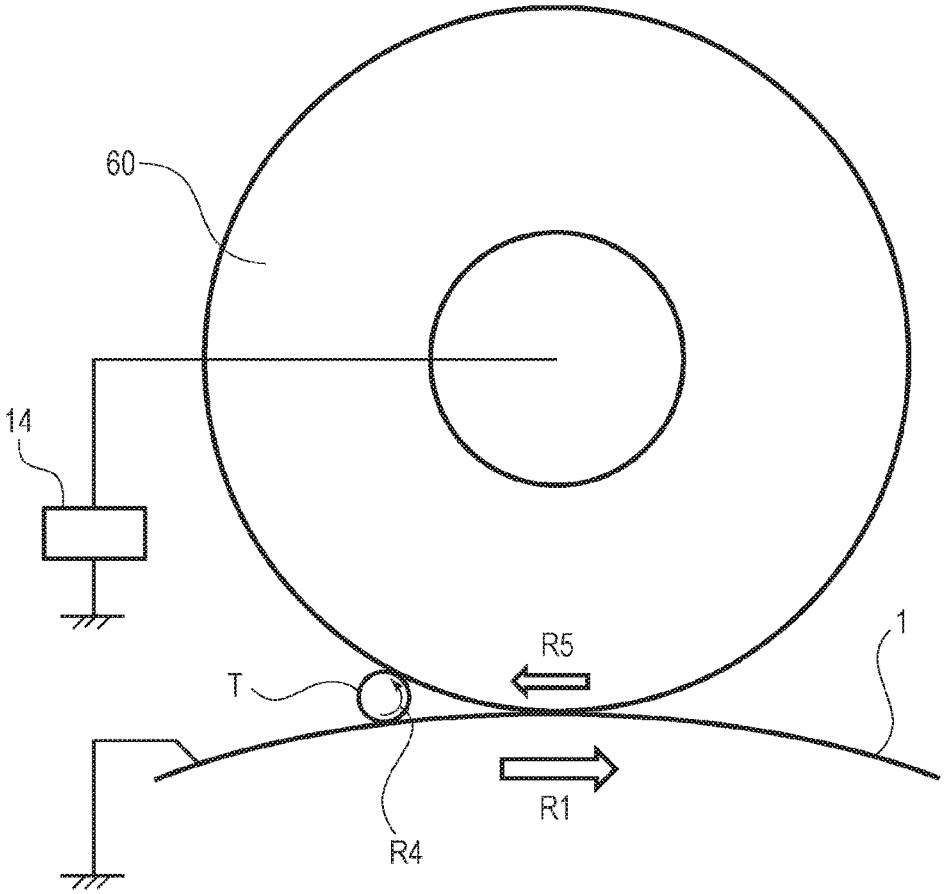
FIG. 10 is a schematic cross-sectional view a region neighboring to an electricity removal roller according to a fourth embodiment.
Figure 11A:
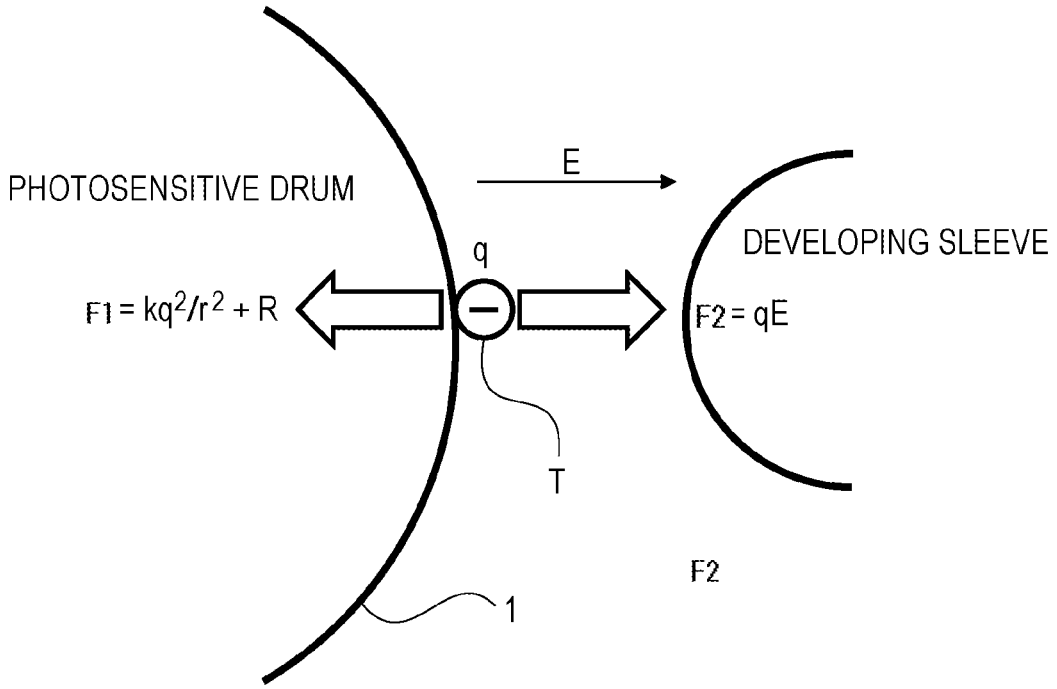
FIGS. 11A and 11B are explanatory diagrams illustrating a relationship between forces applied to toner adhered to a photosensitive drum surface.
Figure 11B:
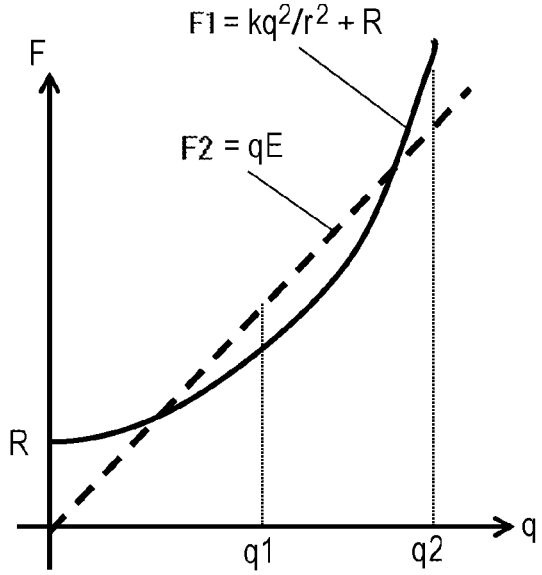
Figure 12:
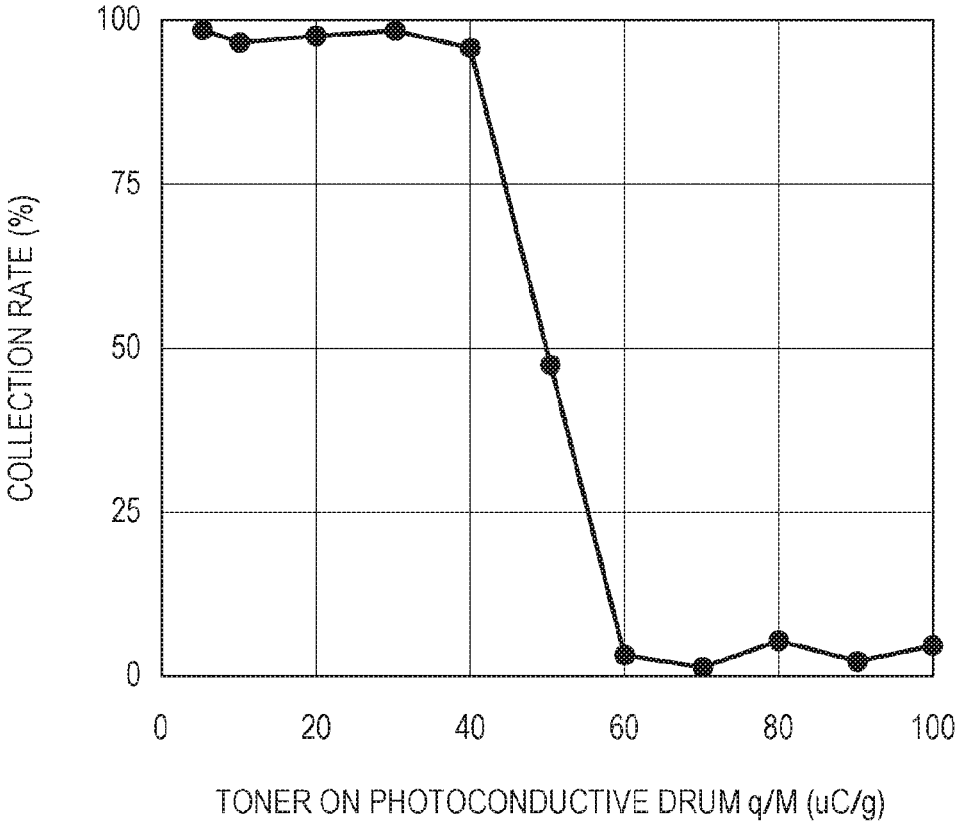
FIG. 12 is a graph illustrating a result of an experiment by comparing a charge amount per unit weight of toner and a collection rate of the toner for finding a relationship therebetween.

Furthermore, according to this embodiment, as illustrated in FIG. 8B, 10 values of intervals between concaves and convexes of the uneven part 50 are measured (Sm1, Sm2, . . . Sm10), and an average value Sm of the 10 interval values is set lower than an average particle size of toner. More specifically, Sm value is set to 5 μm against an average particle size of 8 μm of toner. This configuration can prevent the toner from stopping at the electricity removal nip.

Next, results of an experiment comparing electricity removal rates of toner will be described in a configuration having the uneven part 50 of the electricity removal sheet 7. Here, the electricity removal rates were calculated by the Expression (1). The value of |charged potential VD before electricity removal|−|electricity removal bias VR| is set to 50 V.

This experiment resulted in an electricity removal rate of 80% in a configuration with the uneven part 50 and an electricity removal rate of 50% in a configuration without it. From this experiment results, it was found that the configuration with the electricity removal sheet 7 having undergone the unevenness treatment can improve the toner electricity removal rate.

Fourth Embodiment

Next, a fourth embodiment of the image forming apparatus A according to the present disclosure will be described. Like numbers refer to like parts in descriptions and drawings of the first to fourth embodiments, and any repetitive description will be omitted.

Figure 9:
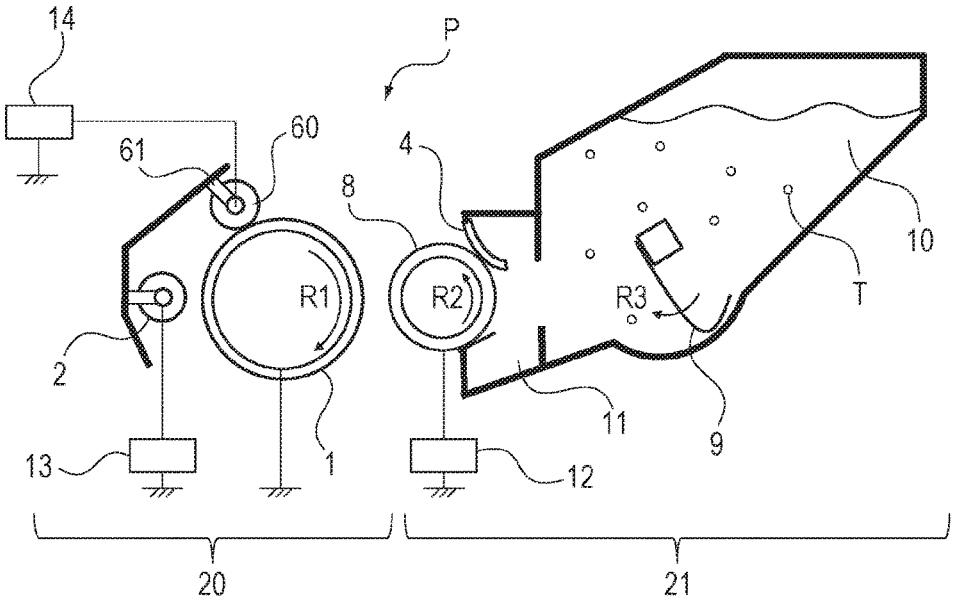
FIG. 9 is a schematic cross-sectional view illustrating a process cartridge according to a fourth embodiment.

According to this embodiment, as illustrated in FIG. 9, a conductive electricity removal roller 60 in contact with the photosensitive drum 1 is applied as an electricity removal member. The electricity removal roller 60 is coated by rubber having a sufficiently lower electrical resistance value and is supported rotatably by a supporting portion 61. The electricity removal sheet 7 is disposed on a downstream side from a charging position facing the charging roller 2 in a rotation direction (moving direction of the surface of the photosensitive drum 1) of the photosensitive drum 1 and disposed on an upstream side from the development position facing the developing sleeve 8 and are arranged in contact with the surface of the photosensitive drum 1. The electricity removal high-voltage power supply 14 (bias applying member) provided in the main body of the image forming apparatus A is configured to apply a bias.

In the electricity removal step, the electricity removal roller 60 performs electricity removal on charge-up toner, like the processing using the electricity removal sheet 7 according to the first embodiment. That is, in an image-forming period, a direct-current electricity removal bias VR is applied to the electricity removal roller 60 where the electricity removal bias VR has the same polarity as the charging polarity of the surface of the photosensitive drum 1 and is smaller in absolute value than the charged potential VD. The rotation of the photosensitive drum 1 brings the electricity removal roller 60 to which the electricity removal bias VR is applied and the charge-up toner adhered to the surface of the photosensitive drum 1 into contact.

Thus, the charges on a surface of the charge-up toner can be released to a ground side through the electricity removal roller 60 so that the amount of charges of the residual toner can be reduced and electricity removal can be performed on the charge-up toner. The collection rate for collecting residual toner by the developing sleeve 8 can be improved.

The electricity removal roller 60 includes a rotating mechanism, not illustrated, and rotates in a rotation direction R5 opposite against the rotation direction R1 of the photosensitive drum 1 as illustrated in FIG. 10. Thus, at an electricity removal nip formed by the photosensitive drum 1 and the electricity removal roller 60, toner may exhibit the following behavior.

First, toner having moved along the rotation direction R1 of the photosensitive drum 1 receives a shearing force from the electricity removal roller 60 rotating in the rotation direction R5. The shearing force causes toner particles T to rotate in a direction R4 opposite against the rotation direction R1 of the photosensitive drum 1 and to pass through the electricity removal nip at a lower speed than the rotation speed of the photosensitive drum 1.

The long period taken by the toner to pass therethrough can increase the opportunities for charges on the surfaces of the toner particles T to be brought contact with the surface of the electricity removal roller 60 so that the toner electricity removal rate can be improved. Therefore, the charging bias Vc can be set lower in consideration of the amount of charges to be removed by the electricity removal roller 60, which can reduce the risk for leakage of the charging bias Vc.

An unevenness treatment may be performed on the surface of the electricity removal roller 60 so that the electricity removal efficiency of the electricity removal roller 60 can further be improved, like the electricity removal sheet 7 according to the third embodiment. The Sm value of an uneven part having undergone the unevenness treatment may be set to be equal to or smaller than an average size of particles of toner to prevent the toner from stopping at the electricity removal nip.

Next, results of an experiment will be described where the experiment compares electricity removal rates of toner in a non-rotation mode where the electricity removal roller 60 does not rotate, a forward-rotation mode where the electricity removal roller 60 rotates in the same direction as that of the photosensitive drum 1, and a reverse rotation mode where the electricity removal roller 60 rotates in the reverse direction. In this experiment, a toner electricity removal rate was calculated by using Expression (1) as described above. The value of |charged potential VD before electricity removal|−|electricity removal bias VR| is set to 50 V.

As a result of the experiment, when in the non-rotation mode and the forward-rotation mode, the electricity removal rate was 50%. On the other hand, in the reverse rotation mode, the electricity removal rate was 80%. Also from this experiment result, when the electricity removal roller 60 is rotated in the direction opposite against the rotation direction of the photosensitive drum 1, a higher electricity removal rate can be obtained than those in the non-rotation mode and the forward rotation mode.

In the configuration of this embodiment, a bias (voltage) having the same polarity as that of the charged potential VD of the photosensitive drum 1 in an image-forming period is applied to the electricity removal roller 60 in a non-image-forming period to move toner adhered to the electricity removal roller 60 to the photosensitive drum 1, like the second embodiment. This can improve poor electricity removal due to the toner adhesion.

Having described that, as the electricity removal member, the electricity removal sheet 7 being a sheet-shaped member according to the first to third embodiments or the electricity removal roller 60 being a roller-shaped member according to the fourth embodiment are used, embodiments of the present disclosure are not limited thereto. In other words, the electricity removal member is not limited in shape and material if the electricity removal member is brought into contact with toner on the photosensitive drum 1, applies a direct current bias to form an electric field between the electricity removal member and the surface of the photosensitive drum 1, and moves charges of the toner to a ground side.

While the present invention has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application. No. 2016-097589 filed May 16, 2016, which is hereby incorporated by reference herein in its entirety.

What is claimed is:

1. An image forming apparatus, comprising:

a rotatable image bearing member;

a charging member configured to charge the image bearing member to make a surface potential of the image bearing member;

a developing member configured to develop an electrostatic latent image formed on a surface of the image bearing member and collect a developer adhered to the image bearing member;

an electricity removal member disposed downstream of the charging member and upstream of the developing member in a rotating direction of the image bearing member and arranged in contact with the image bearing member; and an applying member configured to apply a direct-current (DC) bias to the electricity removal member in an image-forming period, wherein the DC bias has a polarity identical to a charging polarity of the image bearing member and has an absolute value lower than that of the surface potential of the image bearing member.

2. The image forming apparatus according to claim 1, further comprising:

an exposing unit configured to expose the image bearing member, wherein the applying member applies the DC bias to the electricity removal member, the DC bias having an absolute value higher than that of the surface potential of the image bearing member after exposed.

3. The image forming apparatus according to claim 1, wherein the applying member in a non-image-forming period applies the DC bias to the electricity removal member, the DC bias having the polarity identical to the charging polarity of the image bearing member in the image-forming period.

4. The image forming apparatus according to claim 3, wherein the applying member in the non-image-forming period applies the DC bias to the electricity removal member, the DC bias having an absolute value higher than that of the surface potential of the image bearing member in the image-forming period.

5. The image forming apparatus according to claim 1, wherein the electricity removal member has a surface having undergone an unevenness treatment.

6. The image forming apparatus according to claim 5, wherein an average of 10 values of intervals between concaves and convexes of the surface having undergone the unevenness treatment of the electricity removal member is smaller than an average particle size of a developer.

7. The image forming apparatus according to claim 1, wherein the electricity removal member is a sheet-shaped electricity removal sheet.

8. The image forming apparatus according to claim 1, wherein the electricity removal member is a roller-shaped electricity removal roller.

9. The image forming apparatus according to claim 8, wherein the electricity removal roller rotates in a direction opposite against the rotating direction of the image bearing member.

10. The image forming apparatus according to claim 1, wherein the charging member is provided in noncontact with the image bearing member.

11. A process cartridge detachably attached to an image forming apparatus, the process cartridge comprising:

a rotatable image bearing member;

a charging member configured to charge the image bearing member to make a surface potential of the image bearing member;

a developing member configured to develop an electrostatic latent image formed on a surface of the image bearing member and collect a developer adhered to the image bearing member; and an electricity removal member disposed downstream of the charging member and upstream of the developing member in a rotating direction of the image bearing member and arranged in contact with the image bearing member, wherein the electricity removal member is applied a direct-current (DC) bias in an image-forming period, the DC bias having a polarity identical to a charging polarity of the image bearing member and having an absolute value lower than that of the surface potential of the image bearing member.

12. The process cartridge according to claim 11, wherein the image forming apparatus has an exposing unit configured to expose the image bearing member; and wherein the electricity removal member is applied the DC bias having an absolute value higher than that of the surface potential of the image bearing member after exposed by the exposing unit.

13. The process cartridge according to claim 11, wherein the electricity removal member in a non-image-forming period is applied the DC bias having the polarity identical to the charging polarity of the image bearing member in the image-forming period.

14. The process cartridge according to claim 13, wherein the electricity removal member in the non-image-forming period is applied the DC bias having an absolute value higher than that of the surface potential of the image bearing member in the image-forming period.

15. The process cartridge according to claim 11, wherein the electricity removal member has a surface having undergone an unevenness treatment.

16. The process cartridge according to claim 15, wherein an average of 10 values of intervals between concaves and convexes of the surface having undergone the unevenness treatment of the electricity removal member is smaller than an average particle size of a developer.

17. The process cartridge according to claim 11, wherein the electricity removal member is a sheet-shaped electricity removal sheet.

18. The process cartridge according to claim 11, wherein the electricity removal member is a roller-shaped electricity removal roller.

19. The process cartridge according to claim 18, wherein the electricity removal roller rotates in a direction opposite against the rotating direction of the image bearing member.

20. The process cartridge according to claim 11, wherein the charging member is provided in noncontact with the image bearing member.

* * * * *